US008340873B2

(12) United States Patent
Finley et al.

(10) Patent No.: US 8,340,873 B2
(45) Date of Patent: Dec. 25, 2012

(54) MACHINE CONTROL AND GUIDANCE SYSTEM INCORPORATING A PORTABLE DIGITAL MEDIA DEVICE

(75) Inventors: Jeffrey Lynn Finley, Tipp City, OH (US); Bruce W. Enix, Huber Heights, OH (US)

(73) Assignee: Caterpillar Trimble Control Technologies, LLC, Dayton, OH (US)

( * ) Notice: Subject to any disclaimer, the term of this patent is extended or adjusted under 35 U.S.C. 154(b) by 485 days.

(21) Appl. No.: 12/690,516

(22) Filed: Jan. 20, 2010

(65) Prior Publication Data

US 2011/0178677 A1 Jul. 21, 2011

(51) Int. Cl.
*G06F 7/70* (2006.01)

(52) U.S. Cl. ..... 701/50; 414/699

(58) Field of Classification Search ..... 701/36, 701/50; 702/105; 414/699; 455/41.2
See application file for complete search history.

(56) References Cited

U.S. PATENT DOCUMENTS 8,145,394 B2 * 3/2012 Chiorean et al. ..... 701/50
8,195,344 B2 * 6/2012 Song et al. ..... 701/2
2003/0161906 A1 8/2003 Braunhardt et al.
2006/0026101 A1 2/2006 Ogura et al.
2008/0091507 A1 4/2008 Bankston et al.
2009/0239587 A1 9/2009 Negron et al.
2009/0259373 A1 10/2009 Nichols et al.

FOREIGN PATENT DOCUMENTS

DE 10 2009 016 36 12/2009
EP 1 983 305 10/2008

OTHER PUBLICATIONS

PCT International Search Report and Written Opinion dated Apr. 27, 2011 pertaining to PCT Application No. PCT/US2011/020776.

* cited by examiner

*Primary Examiner* — Richard M. Camby
(74) *Attorney, Agent, or Firm* — Dinsmore & Shohl LLP

(57) ABSTRACT

A machine control and guidance system for an earthmoving machine, includes one or more sensors and a portable digital media device mounted on the earthmoving machine. The portable digital media device may comprise an iPhone, an iTouch, or other similar device. Each of the sensors senses the position or orientation of a portion of the earthmoving machine and provides a wireless output signal indicating the position or orientation. The portable digital media device is in wireless communication with each of the sensors. The device has an associated display and a memory in which is stored an application program which permits the device to determine the position of one or more portions of the earthmoving machine and to display the position of one or more portions of the earthmoving machine on the display.

21 Claims, 5 Drawing Sheets

MACHINE CONTROL AND GUIDANCE SYSTEM INCORPORATING A PORTABLE DIGITAL MEDIA DEVICE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This relates to a machine control and guidance system for an earthmoving machine, a method of operation of such a system, and a non-transitory computer-readable medium with an executable program thereon for an earthmoving machine. A variety of earthmoving machines are available for use in construction and in similar applications to alter landscape or remove or lay pavement. Typical examples include track type tractors, motor graders, wheel loaders, track loaders, hydraulic excavators, scrapers, skid steer loaders, backhoe loaders, asphalt and concrete milling machines, asphalt and concrete paving machines, and landfill, soil and asphalt compactors. A number of smaller, less expensive machines of this type have become popular, and their use on small projects by unskilled operators has become more commonplace. Many of these machines are available for rental. Even with small projects, the use of such a machine is greatly enhanced by simple, easily mastered controls. Unfortunately, the control systems for machines of this type are usually relatively complicated, and commensurately expensive.

A machine control and guidance system for an earthmoving machine commonly performs any or all of a number of the following functions. The machine control and guidance system may Indicate the position of the machine and its work tool to the machine operator or to a supervisor not on the machine. The machine control and guidance system may control the movement of some portion of the machine, such as steering and braking, or the machine work tool. The system may indicate the position of the work tool to the machine operator or to a supervisor, and also control the position of the work tool as it moves to a desired final location. Additionally, the machine control and guidance system may provide production information to an on-board or off-board system to keep track of the work done by the machine. The system may provide production data to a remote location in real time, while the machine is being operated, permitting the supervisor of the machine operator to monitor progress at the work site. This information may also be used to compute charges for the use of the machine, if the machine is being rented on a usage basis.

While sophisticated control systems have been developed and used quite successfully on expensive earthmoving machines, control systems for less expensive machines, especially those that are included in a machine rental operation, have been less successful. Control systems are vulnerable to damage in the harsh environment in which the machines are used. Additionally, operators who have rented the machines are perhaps less careful in maintaining the control systems and ensuring that they are not damaged.

Accordingly, there is a need for a machine control and guidance system which is rugged, relatively inexpensive, which does not require significant investment by the owner of a machine rental business, and which provides flexibility in operation.

SUMMARY OF THE INVENTION

These needs are met by a machine control and guidance system for an earthmoving machine, a method of operation of such a system, and a non-transitory computer-readable medium with an executable program thereon. The system includes one or more sensors mounted on the earthmoving machine. Each of the sensors senses the position or orientation of a portion of the earthmoving machine and provides a wireless output signal indicating the position or orientation. A portable digital media device is mounted on the earthmoving machine and is in wireless communication with each of the one or more sensors. The device has an associated display and a memory in which is stored an application program which permits the device to determine the position of one or more portions of the earthmoving machine and to display the position of one or more portions of the earthmoving machine on the display.

The earthmoving machine may include a control cab from which an operator may control the operation of the earthmoving machine, and the system may further comprise a mounting device for mounting the portable digital media device in the control cab of the earthmoving machine. The mounting device may include a temporary attachment mechanism for temporarily attaching the portable digital media device to the earthmoving machine in the control cab. The temporary attachment mechanism may be permanently secured in the control cab and define a cradle within which the portable digital media device is received for use in the system.

The application program stored in memory of the portable digital media device may permit control data to be downloaded into memory such that the portable digital media device also displays the desired position of one or more portions of the earthmoving machine on the display while also displaying the actual position of one or more portions of the earthmoving machine on the display. The application program stored in memory of the portable digital media device may permit control signals to be generated to by the portable digital media device for controlling operation of the earthmoving machine in dependence upon the difference between the actual position of one or more portions of the earthmoving machine and the desired position of one or more portions of the earthmoving machine. The application program stored in memory may store data related to operation of the earthmoving machine. The portable digital media device transmits the data related to the operation of the earthmoving machine wirelessly to a remote location.

A machine control and guidance method for an earthmoving machine having an operator control interface, may include the steps of a.) providing an earthmoving machine, b.) providing one or more sensors mounted on the earthmoving machine, each of the one or more sensors sensing the position or orientation of a portion of the earthmoving machine and providing a wireless output signal indicating the position or orientation, c.) providing a portable digital media device, the device having an associated display and memory, d.) downloading an application program to the portable digital media device for storage in the memory, and e.) mounting the portable digital media device on or adjacent the operator interface of the earthmoving machine, such that the device, under control of the application program, wirelessly communicates with one or more of the sensors, determines the position of one or more portions of the earthmoving machine, and displays the position of one or more portions of the earthmoving machine on the display at the operator control interface.

The earthmoving machine may include a control cab from which an operator may control the operation of the earthmoving machine on the operator control interface, and the step of mounting the portable digital media device on or adjacent the operator interface may include the step of mounting the portable digital media device in the control cab of the earthmoving machine. The step of mounting the portable digital media device on or adjacent the operator interface may include the step of temporarily attaching the portable digital media device to the earthmoving machine in the control cab. The step of mounting the portable digital media device on or adjacent the operator interface may include the step of the temporary attaching the portable digital media device to a mechanism that is permanently secured in the control cab and that defines a cradle within which the portable digital media device is received for use in the system.

The portable digital media device may also display the desired position of one or more portions of the earthmoving machine on the display while displaying the actual position of one or more portions of the earthmoving machine on the display. The application program stored in the memory of the portable digital media device permits control signals to be generated by the portable digital media device for controlling operation of the earthmoving machine in dependence upon the difference between the actual position of one or more portions of the earthmoving machine and the desired position of one or more portions of the earthmoving machine. The application program stored in memory of the portable digital media device may permit data related to the operation of the earthmoving machine to be stored and transmitted to a remote location.

A non-transitory computer-readable medium has stored an executable program. The program instructs a processor of a portable digital media device to perform a machine control and guidance method for an earthmoving machine that includes the steps of: providing an earthmoving machine with one or more sensors mounted on the earthmoving machine, each of the sensors sensing the position or orientation of a portion of the earthmoving machine and providing a wireless output signal indicating the position or orientation, providing a portable digital media device, the device having an associated display, processor and memory, downloading an application program to the portable digital media device for storage in the memory, and mounting the portable digital media device on or adjacent an operator interface of the earthmoving machine. By this arrangement, the device, under control of the application program, wirelessly communicates with the one or more sensors, determines the position of one or more portions of the earthmoving machine, and displays the position of one or more portions of the earthmoving machine on the display at the operator control interface.

The program may instruct a processor of a portable digital media device to perform machine control and guidance method for an earthmoving machine including the step of displaying the desired position of one or more portions of the earthmoving machine on the display while also displaying the actual position of one or more portions of the earthmoving machine on the display. The program may instruct a processor of a portable digital media device to perform machine control and guidance method for an earthmoving machine including the step of generating control signals for controlling operation of the earthmoving machine in dependence upon the difference between the actual position of one or more portions of the earthmoving machine and the desired position of one or more portions of the earthmoving machine. The program may instruct a processor of a portable digital media device to perform a machine control and guidance method for the earthmoving machine including the steps of storing data related to the operation of the earthmoving machine, and transmitting the stored data to a remote location.

DETAILED DESCRIPTION OF THE PREFERRED EMBODIMENTS

Figure 1:
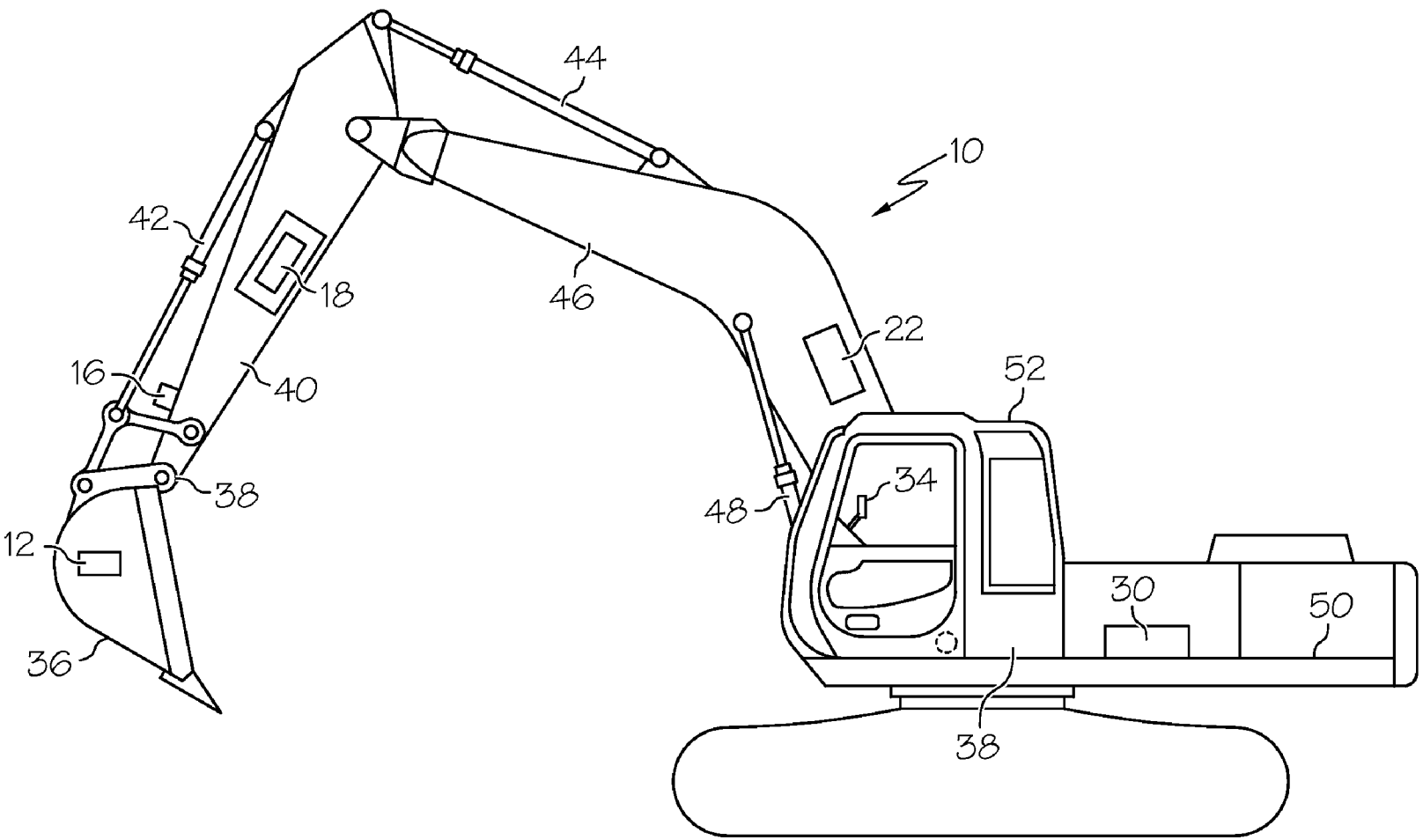
FIG. 1 is a side view of an excavator, illustrating the position of various components.

Reference is made to FIG. 1 which illustrates an earthmoving machine 10, in this illustrated as an excavator. It should be appreciated, however, that the earthmoving machine 10 may alternatively be any similar machine, such as for example a track type tractor, a motor grader, a wheel loader, a track loader, a scraper, a skid steer loader, a backhoe loader, an asphalt or concrete milling machine, an asphalt or concrete paving machine, and a landfill, soil or asphalt compactor. A machine control and guidance system for the earthmoving machine 10 includes one or more sensors, here shown as a plurality of sensors 12, 16, 18, 22, and 30, and a portable digital media device 34. The sensors 12, 16, 18, 22, and 30 are mounted on the earthmoving machine 10, with each of the sensors sensing the position or orientation of a portion of the earthmoving machine 10, and providing a wireless output signal indicating that position or orientation. The sensor 12 is mounted on the bucket 36 of the excavator 10 and provides an indication of the tilt of the bucket from side to side, as seen from the vantage point of the operator in the cab 38 of the excavator 10. The sensor 16 is a bucket linkage sensor which determines the position of the linkage supporting the bucket 36 and the pivoting of the bucket 36 about the pivot 38 at the end of the dipper stick 40. The linkage moves as a result of the extension and retraction of hydraulic cylinder 42. The sensor 18 is a dipper stick sensor which provides an indication of the inclination of the dipper stick 40. The dipper stick 18 is tilted in dependence upon the extension and retraction of the hydraulic cylinder 44. The sensor 22 is a boom sensor which provides an indication of the inclination of the boom 46. The boom 46 is moved in dependence upon the extension and retraction of the hydraulic cylinder 48. The sensor 30 is a car body pitch and roll sensor which senses the orientation of car body 50 of the excavator 10 in two, orthogonal directions, both pitch and roll.

Figure 3:
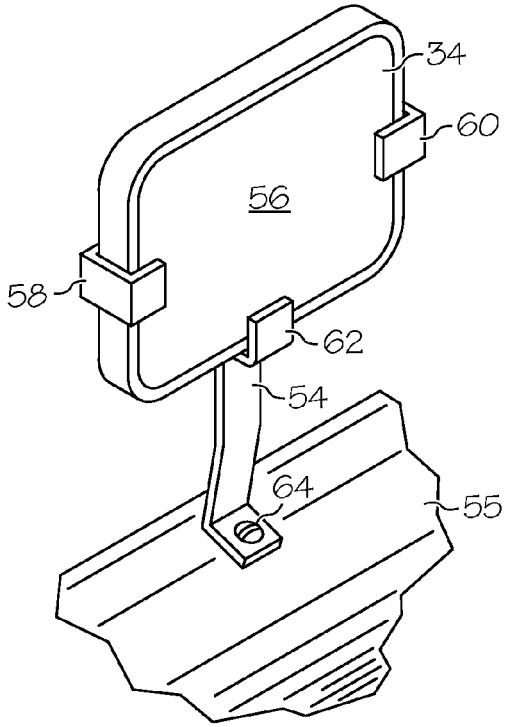
FIG. 3 shows the portable digital media device mounted on an earthmoving machine.

The portable digital media device 34 is mounted on the earthmoving machine 10, and is in wireless communication with each of the plurality of sensors 12, 16, 18, 22, and 30. The device 34 may be a portable digital media device, such as for example an iPhone device from Apple Inc., a Blackberry device from RIM Inc., an Android device from Motorola, Inc., a Nexus One device from Google, Inc., or another similar device having an associated display and a memory in which is stored an application program which permits the device to determine the position of one or more portions of the earthmoving machine and to display the position of one or more portions of the earthmoving machine on the display. The portable digital media device may also be a device, such as an iTouch, which has wireless communication capability, but which does not include a built-in cell phone. Devices, such as the iTouch, may include a wi-fi, Mi-Fi, or other wireless broadband capability. FIGS. 1 and 3 illustrate the device 34 mounted in the control cab 52 of the earthmoving machine 10, from which an operator may control the operation of the earthmoving machine 10. The device 34 is held in a mounting device 54 which is secured to the dashboard 55 or other structure in the front of the cab 52, where the operator can see the display screen 56 of the device 34 as the operator controls the machine 10. The mounting device 54 preferably includes a mechanism for temporarily attaching the portable digital media device 34 to the earthmoving machine 10 in the control cab 52. It will be noted that the mounting device 54 shown in FIG. 3 includes arms 58, 60 and 62 which together define a cradle and within which the portable digital media device 34 is received for use in the system. In the version of the mounting device 54 shown in FIG. 3, the cradle is the temporary attachment mechanism, permitting the device to be readily removed from the cab 52, or added to the control arrangement in the cab 52. The mounting device 54 may be permanently secured in place in the control cab 52, as for example by means of a screw 64, or it may be secured in the control cab through some other, less permanent arrangement. For example, a suction cup arrangement could be affixed to the mounting device 54, permitting it to be secured to a smooth surface within the cab on a more temporary basis.

Figure 5:
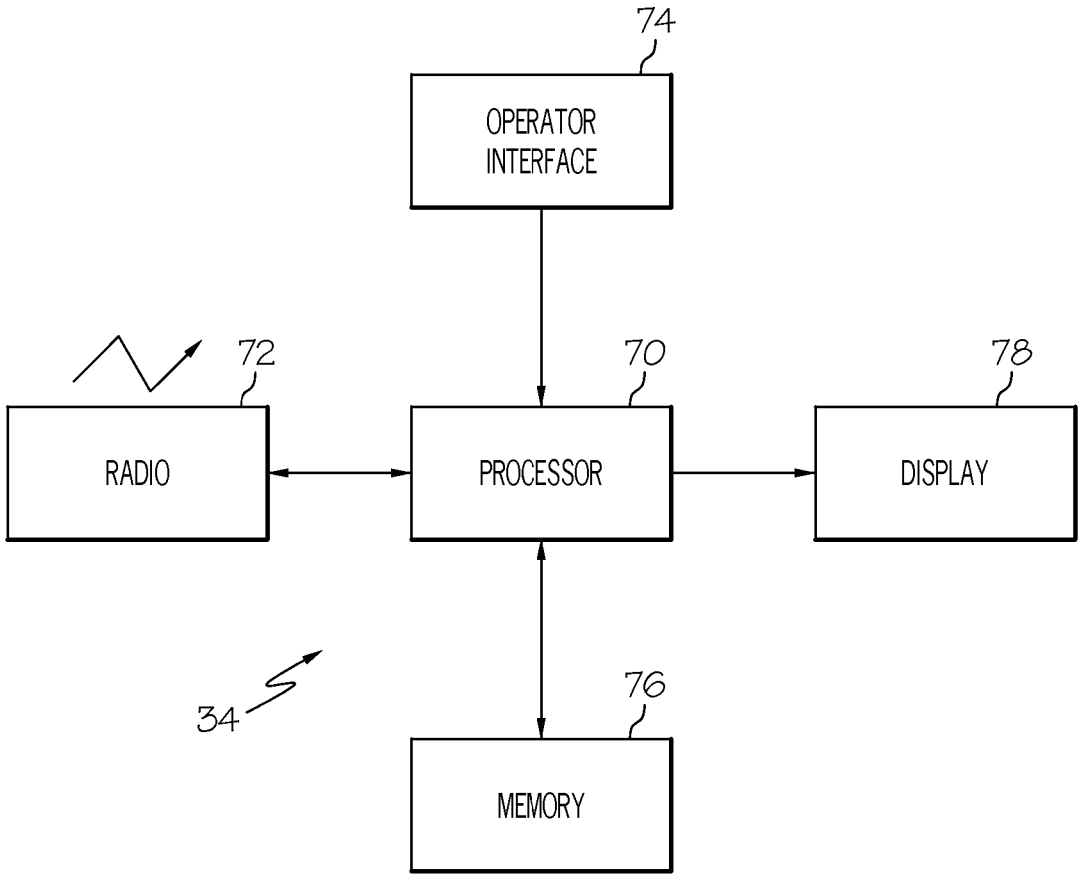
FIG. 5 is a schematic depiction of a portable digital media device.

FIG. 5 is a schematic drawing showing major functional components of the portable digital media device 34. The device 34 typically includes a processor 70 which receives input from a radio circuit 72, an operator interface 74, and a memory 76, and can transmit data, control signals, and display control information to radio 72, memory 76, and display 78. The radio 72 permits the device to communicate wirelessly with sensors, with other remote locations, and with software sources for downloading applications and data for operation of the device 34. It will be appreciated that the device may also have Wi-Fi capability, Bluetooth capability, Zig Bee capability, or the like for communicating over short distances, such as for example with sensors located on the machine. The operator interface 74 and display 78 may be integrated into a single component, such as the touch responsive screen used with the iPhone device and the Nexus One device, among others. Alternatively, the operator interface 74 and display 78 may be structurally distinct components, such as the separate display and mechanical keyboard units found in some Blackberry devices. The portable digital media device may also include a radio circuit (not shown) associated with it cell phone capability, assuming that device 34 includes such cell phone capability.

Figure 2A:
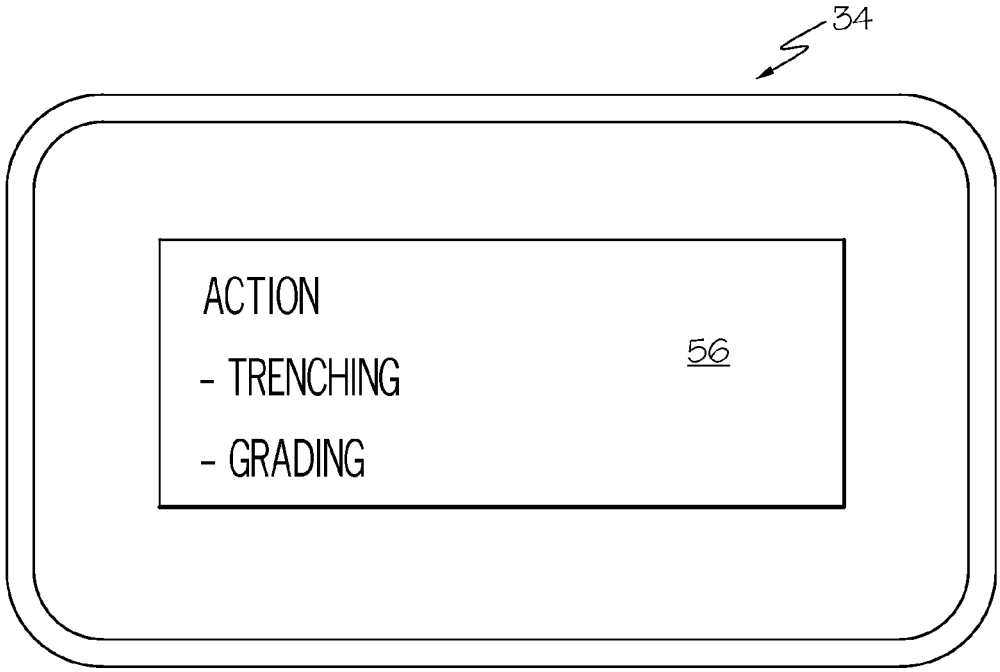
FIGS. 2A, 2B, and 2C show the display screen of a portable digital media device.
Figure 2B:
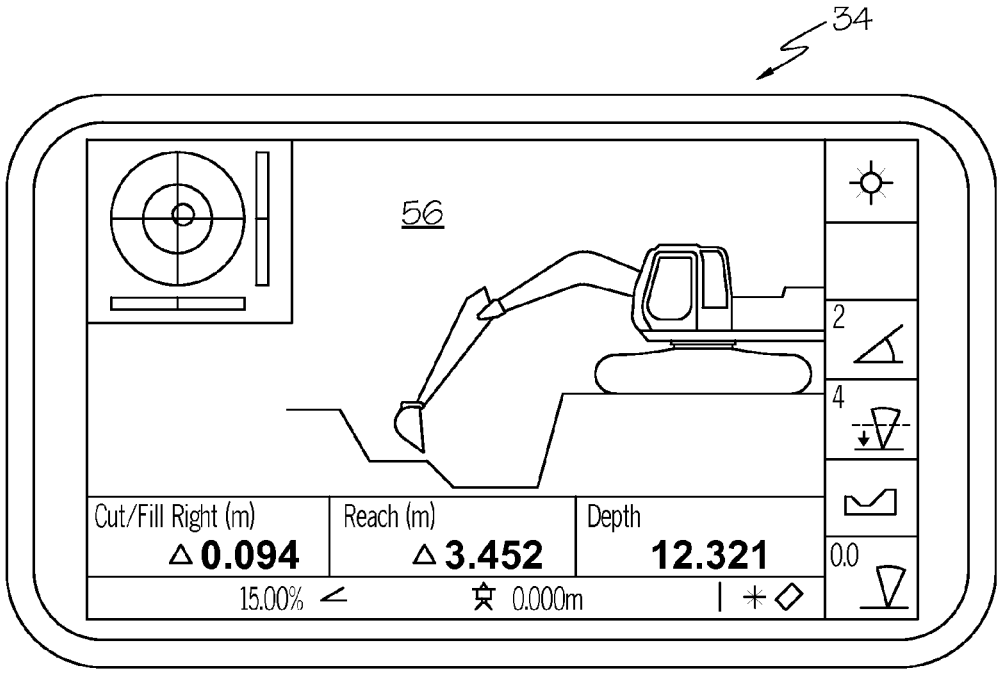
Figure 2C:
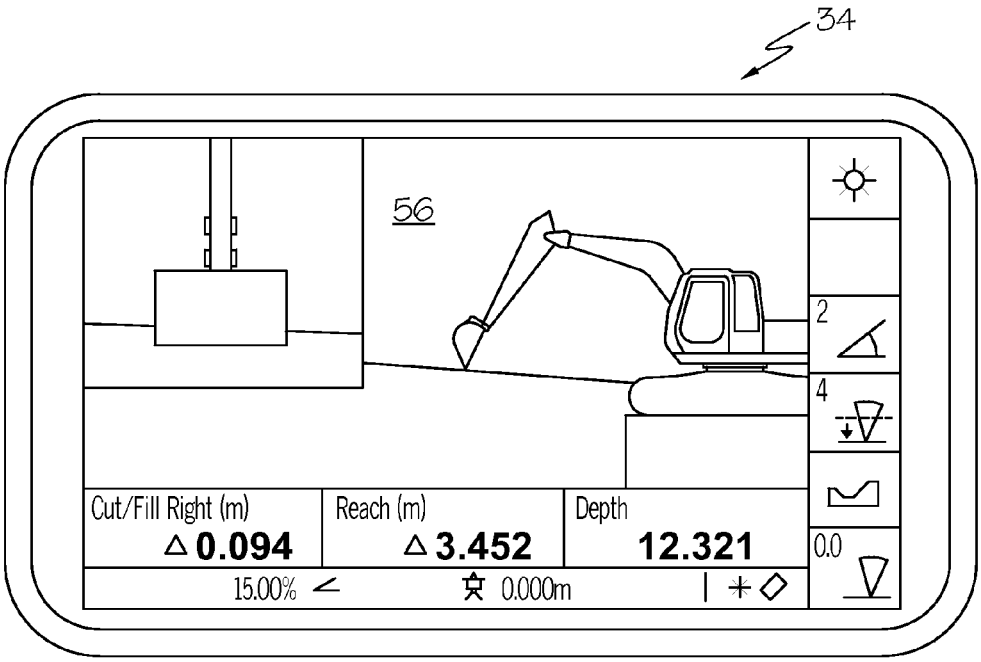

Various application programs can be downloaded over the radio 72 or over the cell phone radio for controlling the operation of the device 34 and the machine 10. An application program may be stored in memory 76 of the portable digital media device 34 to permit control data to be downloaded into memory 76 such that the portable digital media device 34 displays the desired position of one or more portions of the earthmoving machine on the display 78 while also displaying the actual position of one or more portions of the earthmoving machine on the display. This is shown in FIGS. 2A, 2*b* and 2*c*. As seen in FIG. 2A, the touch responsive screen 56 may permit an operator to select among various modes of machine operation, for example between trenching and grading. The display for trenching mode is illustrated in FIG. 2B, while the display for grading mode is shown in FIG. 2C. During trenching, the display 78 shows the position of the bucket, as well as the desired final contour of the trench so that the operator can manipulate the excavator controls to produce the desired result. Similarly, during grading, the display 78 shows the position of the bucket, as well as its lateral tilt, so that the operator can adjust the tilt and position of the bucket to effect the desired final grade. It will be appreciate that in order for the display of the relative position of a desired contour and an actual position of the bucket, it is necessary for the system to determine the location of the machine in three dimensions. This can be accomplished by means of a GPS on the machine by means of a GPS system which may be integral with the portable digital media device 34, by means of combined laser and GPS system, by means of a Total Station, or in some other manner.

The system can also operate on a automatic or semiautomatic basis in which the application program stored in memory 76 of the portable digital media device 34 permits control signals to be generated by the portable digital media device for controlling operation of the earthmoving machine 10 in dependence upon the difference between the actual position of one or more portions of the earthmoving machine, and the desired position of one or more portions of the earthmoving machine. These control signals can then be transmitted wirelessly to a hydraulic valve control circuit for controlling one or more of the hydraulic cylinders 42, 44, and 48. The application program stored in memory 76 may also control storing data related to operation of the earthmoving machine, and transmitting the data wirelessly to a remote location. This data can be used by supervisory personnel to monitor the use of the machine 10. Alternatively, in a machine rental situation, the data can be used to calculate the charge for the rental.

The application programs stored in memory 76 can be any of a wide variety of programs that are designed for specific control or monitor functions for specific machines. The application programs may be downloaded to the portable digital media device wirelessly or may be downloaded over a cable connected to the device. The portable digital media device 34 is preferably mounted on, or adjacent to, the operator interface, such as for example the operator controls in the control cab 52 of the earthmoving machine 10. The device, under control of the application program, wirelessly communicates with the plurality of sensors 12, 16, 18, 22, and 30, determines the position of one or more portions of the earthmoving machine, and displays the position of one or more portions of the earthmoving machine on the display 78 in the cab 52. As a consequence, the machine operator can watch the screen 56 of the display 78 while at the same time controlling the machine.

Figure 4:
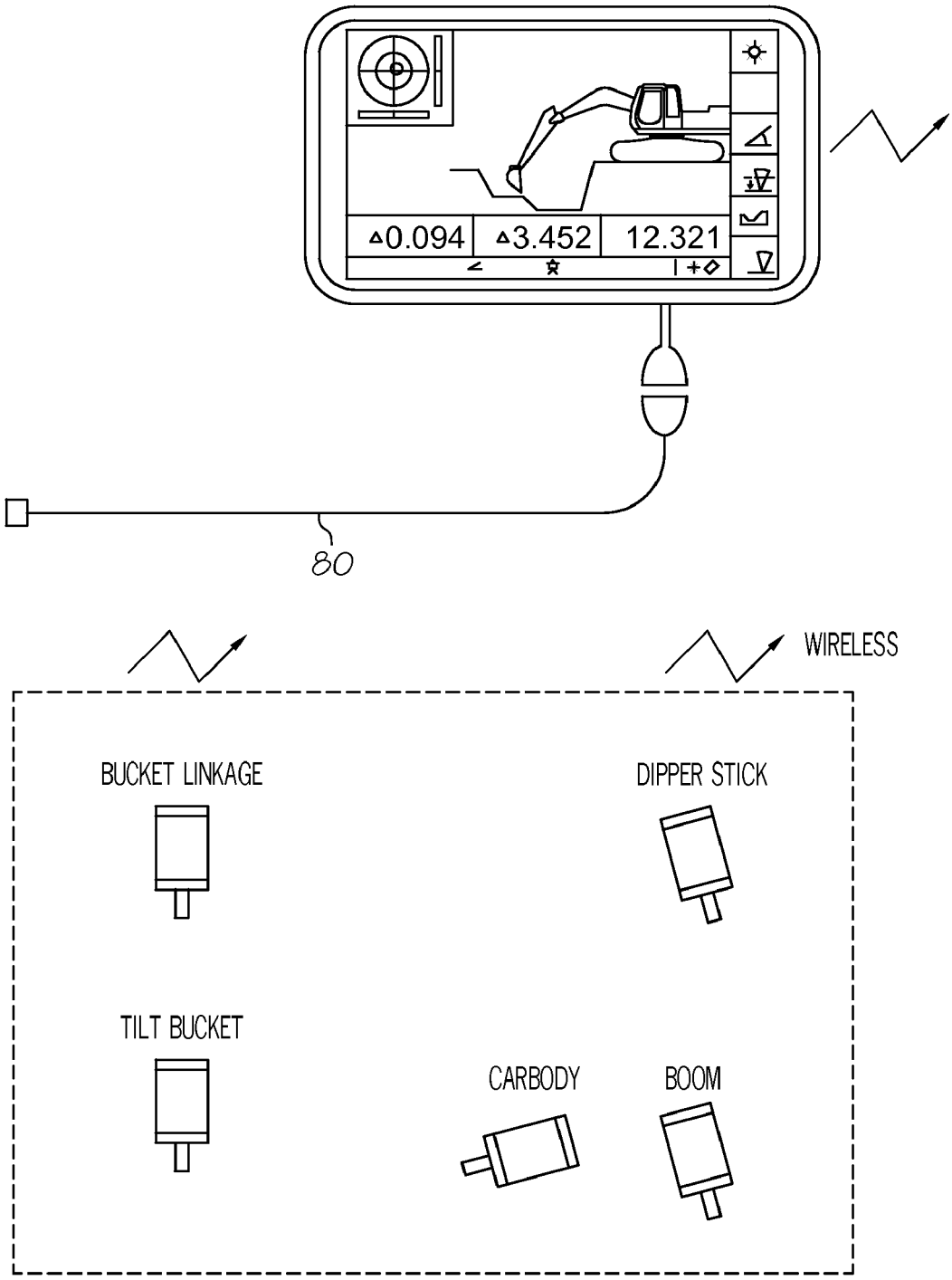
FIG. 4 schematically depicts the portable digital media device in wireless communication with a plurality of sensors mounted on an earthmoving machine.

As illustrated in FIG. 4, the system can be configured to utilize wireless sensors that communicate with the portable digital media device 34 wireless typically via Bluetooth or Wi-Fi connections. The portable digital media device 34 may also be configured to communicate with the sensors and the balance of the machine control system via a cable 80 connected to the data port of the device. In yet another, alternative arrangement, various hybrid combinations of wireless and hardwired connections may be employed. For example, some or all of the sensors may communicate over connectors to a wireless transmission circuit, which then communicates wirelessly with the portable digital media device 34. This may be used advantageously where it is anticipated that these sensors may become submerged during machine operation, reducing the effectiveness of machine operation. Some of the sensors may be wired to machine power, while others may be powered by separate, discrete batteries. Wired components may include electric masts and hydraulic value arrangements which require more power to operate. Any of these arrangements offer significant advantages, including:

1. Lower cost of operation through the use of commercially available portable digital media device and greater utilization of their already existing cellular data plan.
2. Simpler user interface through the broader use of typical portable digital media device user interface features, such as scrolling through screens with the swipe of a finger.
3. Reduced machine complexity, especially through the use of wireless sensors.
4. Reduced installation complexity. The portable digital media device mount may be as simple as a suction cup or magnet mounting with an appropriate cradle. Machine measure up will not be required due to the existing sensor installation. Machine configuration information can be downloaded to the portable digital media device over the air for a plug-and-play operation for the customer.
5. Display portability.

Through the use of the portable digital media device, a system can be configured as an added feature available for rental with the rental machine at a nominal cost to both the rental company and customer. A set of sensors may be included with the machine, typically wireless sensors, and the machine is then ready for the customer to enable the system through the connection via the portable digital media device. This connection can be tied to the asset management system of the rental company and the rental of the machine and the control system can be calculated on any of a number of bases.

The customer renting the earthmoving machine with such a control system can benefit from this arrangement through access to a variety of value added services. The digital site plan for the customer's work can be downloaded directly through and to the portable digital media device, either on site or on the way to the site. Back office applications can be employed to receive data from the machine, tracking its productivity, time on the job, time remaining, and the like. This information can be transmitted in real time from the portable digital media device, or stored on the portable digital media device and sent sometime later, even without intervention by the operator. The portable digital media device can connect via Wi-Fi to GPS base stations or other Wi-Fi enabled devices to transmit and receive information as needed for the job site. The portable digital media device can connect to a VRS source directly or to another device on the machine through a data link, Bluetooth or Wi-Fi, to get GPS position corrections. Billing can be done through a seamless connection between machine productivity and business systems so that the machine contractor can bill his customer in real time or so that the rental company can bill the machine customer for use of the machine, control system, or both. All of the billing can be done through the cell phone connection from the Portable digital media device. Product literature can be downloaded from a central location to provide instructions on the use of the machine, the system or any other applicable feature.

The same portable digital media device that is used on the machine can be used off of the machine at the work site by supervisory personnel to observe the work of the machine remotely and to send information to or receive information from the machine. This additional information may include new digital site files, service information (literature, firmware, software), photographs or movies of the work progress and productivity information, job site location (address, map, GPS coordinates, site contact) and location specific work instructions. This allows the same device, the portable digital media device, to be used throughout the suite of functions on and off of the earthmoving machine, as well as functioning as the primary business information terminal for billing and other business functions.

It will be appreciated that numerous other variations in this system and the operation of the system are contemplated.

What is claimed is:

1. A machine control and guidance system for an earthmoving machine, comprising:

a plurality of sensors mounted on the earthmoving machine, each of said sensors sensing the position or orientation of a portion of the earthmoving machine and providing a wireless output signal indicating said position or orientation, and a portable digital media device, mounted on said earthmoving machine and in wireless communication with each of said plurality of sensors, said device having an associated display and a memory in which is stored, an application program which permits said device to determine the position of one or more portions of the earthmoving machine and to display the position of one or more portions of the earthmoving machine on said display, in which said application program stored in memory of said portable digital media device permits control data to be downloaded into memory such that said portable digital media device also displays the desired position of one or more portions of the earthmoving machine on said display while also displaying the actual position of one or more portions of the earthmoving machine on said display.

2. The machine control and guidance system for an earthmoving machine according to claim 1, said earthmoving machine including a control cab from which an operator may control the operation of the earthmoving machine, said system further comprising a mounting device for mounting said portable digital media device in said control cab of said earthmoving machine.

3. The machine control and guidance system for an earthmoving machine according to claim 2, in which said mounting device includes a temporary attachment mechanism for temporarily attaching said portable digital media device to said earthmoving machine in said control cab.

4. The machine control and guidance system for an earthmoving machine according to claim 3, in which said temporary attachment mechanism is permanently secured in said control cab and defines a cradle within which said portable digital media device is received for use in said system.

5. The machine control and guidance system for an earthmoving machine according to claim 1, in which said application program stored in memory of said portable digital media device permits control signals to be generated to by said portable digital media device for controlling operation of said earthmoving machine in dependence upon the difference between the actual position of one or more portions of the earthmoving machine and the desired position of one or more portions of the earthmoving machine.

6. The machine control and guidance system for an earthmoving machine according to claim 1, in which said application program stored in memory stores data related to operation of the earthmoving machine, and transmits the data related to the operation of the earthmoving machine wirelessly to a remote location.

7. A machine control and guidance method for an earthmoving machine having an operator control interface, comprising the steps of:

providing an earthmoving machine, providing one or more sensors mounted on the earthmoving machine, each of said sensors sensing the position or orientation of a portion of the earthmoving machine and providing a wireless output signal indicating said position or orientation, providing a portable digital media device, said device having an associated display and memory, downloading an application program to said portable digital media device for storage in said memory, and mounting said portable digital media device on or adjacent said operator interface of said earthmoving machine, such that said device, under control of said application program, wirelessly communicates with said one or more sensors, determines the position of one or more portions of the earthmoving machine, displays the position of one or more portions of the earthmoving machine on said display at said operator control interface, and displays the desired position of one or more portions of the earthmoving machine on said display while also displaying the actual position of one or more portions of the earthmoving machine on said display.

8. The machine control and guidance method for an earthmoving machine, according to claim 7, said earthmoving machine including a control cab from which an operator may control the operation of the earthmoving machine on said operator control interface, in which the step of mounting said portable digital media device on or adjacent said operator interface includes the step of mounting said portable digital media device in said control cab of said earthmoving machine.

9. The machine control and guidance method for an earthmoving machine, according to claim 8, in which the step of mounting said portable digital media device on or adjacent said operator interface includes the step of temporarily attaching said portable digital media device to said earthmoving machine in said control cab.

10. The machine control and guidance method for an earthmoving machine, according to claim 8, in which the step of mounting said portable digital media device on or adjacent said operator interface includes the step of said temporary attaching said portable digital media device to a mechanism that is permanently secured in said control cab and that defines a cradle within which said portable digital media device is received for use in said system.

11. The machine control and guidance method for an earthmoving machine, according to claim 7, in which said application program stored in memory of said portable digital media device permits control signals to be generated to by said portable digital media device for controlling operation of said earthmoving machine in dependence upon the difference between the actual position of one or more portions of the earthmoving machine and the desired position of one or more portions of the earthmoving machine.

12. The machine control and guidance method for an earthmoving machine, according to claim 7, in which said application program stored in memory of said portable digital media device permits data related to the operation of the earthmoving machine to be stored and transmitted to a remote location.

13. A non-transitory computer-readable medium with an executable program thereon, wherein the program instructs a processor of a portable digital media device to perform machine control and guidance method for an earthmoving machine carried out by the steps of:

providing an earthmoving machine with one or more sensors mounted on the earthmoving machine, each of said sensors sensing the position or orientation of a portion of the earthmoving machine and providing a wireless output signal indicating said position or orientation, providing a portable digital media device, said device having an associated display, processor and memory, downloading an application program to said portable digital media device for storage in said memory, wherein the program instructs a processor of a portable digital media device to perform machine control and guidance method for an earthmoving machine including the step of displaying the desired position of one or more portions of said earthmoving machine on said display while also displaying the actual position of one or more portions of the earthmoving machine on said display, and mounting said portable digital media device on or adjacent an operator interface of said earthmoving machine, such that said device, under control of said application program, wirelessly communicates with said one or more sensors, determines the position of one or more portions of the earthmoving machine, and displays the position of one or more portions of the earthmoving machine on said display at said operator control interface.

14. The non-transitory computer-readable medium with an executable program thereon of claim 13, wherein the program instructs a processor of a portable digital media device to perform machine control and guidance method for an earthmoving machine including the step of generating control signals for controlling operation of said earthmoving machine in dependence upon the difference between the actual position of one or more portions of the earthmoving machine and the desired position of one or more portions of the earthmoving machine.

15. The non-transitory computer-readable medium with an executable program thereon of claim 13, wherein the program instructs a processor of a portable digital media device to perform machine control and guidance method for an earthmoving machine including the steps of storing data related to the operation of the earthmoving machine, and transmitting the stored data to a remote location.

16. A machine control and guidance system for an earthmoving machine, comprising:

one or more sensors mounted on the earthmoving machine, each of said sensors sensing the position or orientation of a portion of the earthmoving machine and providing a wireless output signal indicating said position or orientation, and a portable digital media device, mounted on said earthmoving machine and in wireless communication with each of said one or more sensors, said device having an associated display and a memory in which is stored, an application program which permits said device to determine the position of one or more portions of the earthmoving machine and to display the position of one or more portions of the earthmoving machine on said display, in which said application program stored in memory of said portable digital media device permits control data to be downloaded into memory such that said portable digital media device also displays the desired position of one or more portions of the earthmoving machine on said display while also displaying the actual position of one or more portions of the earthmoving machine on said display.

17. The machine control and guidance system for an earthmoving machine according to claim 16, said earthmoving machine including a control cab from which an operator may control the operation of the earthmoving machine, said system further comprising a mounting device for mounting said portable digital media device in said control cab of said earthmoving machine.

18. The machine control and guidance system for an earthmoving machine according to claim 17, in which said mounting device includes a temporary attachment mechanism for temporarily attaching said portable digital media device to said earthmoving machine in said control cab.

19. The machine control and guidance system for an earthmoving machine according to claim 18, in which said temporary attachment mechanism is permanently secured in said control cab and defines a cradle within which said portable digital media device is received for use in said system.

20. The machine control and guidance system for an earthmoving machine according to claim 16, in which said application program stored in memory of said portable digital media device permits control signals to be generated to by said portable digital media device for controlling operation of said earthmoving machine in dependence upon the difference between the actual position of one or more portions of the earthmoving machine and the desired position of one or more portions of the earthmoving machine.

21. The machine control and guidance system for an earthmoving machine according to claim 16, in which said application program stored in memory stores data related to operation of the earthmoving machine, and transmits the data related to the operation of the earthmoving machine wirelessly to a remote location.

* * * * *